US006227313B1

(12) United States Patent
Davis et al.

(10) Patent No.: US 6,227,313 B1
(45) Date of Patent: May 8, 2001

(54) ANTI-TORQUE TOOL

(75) Inventors: John Phillip Davis, Cypress; Gerald D. Lynde, Houston, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/360,322

(22) Filed: Jul. 23, 1999

(51) Int. Cl.[7] ..... E21B 23/00

(52) U.S. Cl. ..... 175/89; 166/212; 166/237; 175/325.3

(58) Field of Search ..... 175/89, 99, 107, 175/90, 325.3; 166/212, 242.1, 237

(56) References Cited

U.S. PATENT DOCUMENTS

| | | | |
|---|---|---|---|
| 1,870,697 | 8/1932 | Taylor . | |
| 2,056,471 | 10/1936 | Krall | 255/4 |
| 3,225,843 * | 12/1965 | Ortloff et al. | 175/99 |
| 4,154,310 | 5/1979 | Konstantinovsky . | |
| 4,377,207 | 3/1983 | Kofahl | 166/212 |
| 4,612,987 | 9/1986 | Cheek | 166/212 |
| 4,811,785 | 3/1989 | Weber | 166/242 |
| 4,819,760 | 4/1989 | Petermann | 181/102 |
| 5,033,558 | 7/1991 | Russo et al. | 175/325 |

FOREIGN PATENT DOCUMENTS 2341620 3/2000 (GB) .

OTHER PUBLICATIONS

Hydraulic Expanding Mill; Tri–State drawing showing a milling tool having expanding mechanism similar to the expanding mechanism used in the disclosed embodiment of the Anti–Torque Tool; drawing not published—milling tool designed prior to date of conception of the invention.

* cited by examiner

*Primary Examiner*—William Neuder
(74) *Attorney, Agent, or Firm*—Gerald W. Spinks

(57) ABSTRACT

A downhole tool for engaging a borehole wall of a well, with outwardly displacing gripping elements to engage the borehole wall in such a way as to prevent rotation of the tool relative to the borehole wall, thereby preventing a downhole motor from imposing a reactive torque on the workstring uphole from the tool. The gripping elements can have one or more rolling elements, such as wheels, to roll longitudinally along the borehole wall in either the uphole or downhole direction, or both, while preventing transmission of reactive torque to the workstring. The gripping elements can also be configured to prevent longitudinal motion of the tool, such as blades. Displacement of the gripping elements can be hydraulically actuated.

5 Claims, 2 Drawing Sheets

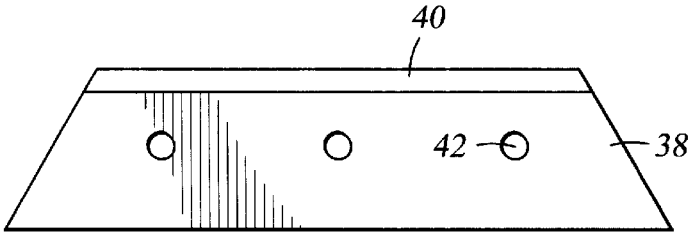
Fig. 8
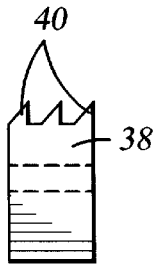
Fig. 9
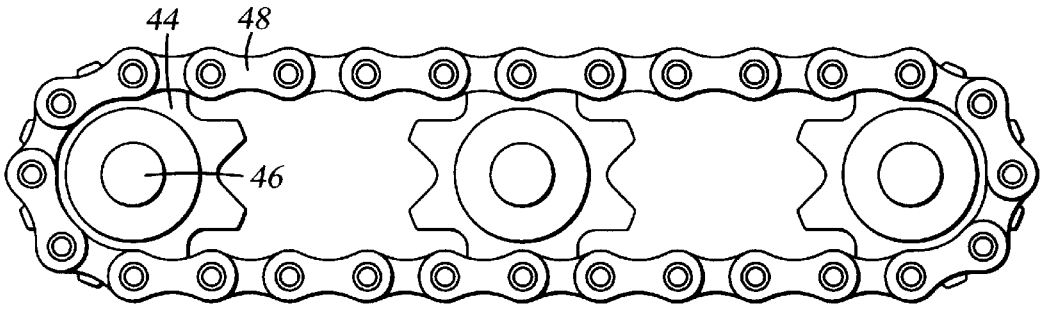
Fig. 10
Fig. 11
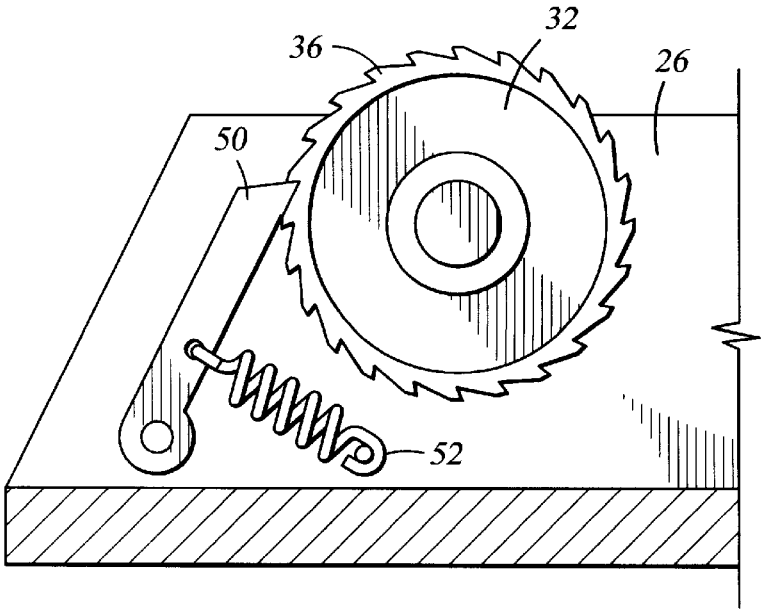

ANTI-TORQUE TOOL

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention is in the field of tools used downhole in oil or gas wells to perform functions such as orienting a tool, drilling a borehole, or milling or cutting a casing positioned in a borehole, using a non-rotating work string. Specifically, this invention concerns a tool used to prevent the imposition of reactive torque on a non-rotating work string when a downhole motor is used, or when a downhole tool is turned for some other purpose.

Background Information

This application will refer to operations being conducted in a borehole, with the understanding that there may or may not be a casing in place in the borehole, and references to a borehole or borehole wall are intended, where appropriate, to include reference to a casing or casing wall, within a borehole, as will be apparent from the context. Downhole operations in an oil or gas well are often conducted by tools attached to the lower end of a length of small diameter, or relatively thin, non-rotating tubing which has been positioned in the borehole. Many such downhole operations, for example, will be conducted with "coiled tubing" which has been uncoiled and run into the borehole.

Such operations often require the rotation of a tool at the downhole end of the stationary work string tubing. Rotation of the downhole tool may be a continuous forceful rotation, accomplished by means of a downhole motor, such as a mud motor, as is often done to rotate a drill bit, a milling tool, or a casing cutter. Further, a downhole tool may be rotated incrementally, and less forcefully, to orient a tool face in a desired direction. In the case of continuous forceful rotation, the downhole motor also imparts a forceful reactive torque to the work string to which it is attached, which can even exceed the torque limit of the work string. In the case of less forceful incremental rotation, reactive twisting of the work string, however slight, can cause inaccuracy in the orientation of the downhole tool. In either case, it would be desirable to have a torque barrier which can be installed between the non-rotating work string and the downhole rotating tool, to prevent the imposition of reactive torque on the work string uphole from the torque barrier.

BRIEF SUMMARY OF THE INVENTION

The present invention is a downhole torque barrier, or anti-torque tool, which engages the wall of the borehole or casing in which it is positioned, with at least one gripping member therein. The gripping member is designed to prevent rotation of the torque barrier relative to the borehole wall or casing wall. The gripping members are preferably hydraulically displaced in a generally outward direction, transverse to the longitudinal axis of the tool, until they engage the wall of the borehole. An outwardly facing surface of at least one of the gripping members has gripping contours designed to engage the borehole or casing wall and prevent rotational movement relative thereto, such as teeth, ridges, or ribs. The tool can be actuated by increasing the pressure of fluid being pumped downhole, to displace the gripping members outwardly until they engage the borehole wall or casing. Thereafter, the downhole motor or other downhole rotating tool can be operated, with all of the reactive torque being absorbed by the anti-torque tool. This isolates the downhole torque from the work string.

The gripping members can be configured to allow movement of the anti-torque tool either uphole or downhole, or both, to allow the advance or retreat of the downhole assembly as desired. This can be done by implementing one or more wheels, or other rolling devices, in the gripping member. The rolling device can be allowed to roll in both longitudinal directions, or a mechanism such as a ratchet can be used to allow longitudinal movement in only the uphole direction or only the downhole direction. Alternatively, the gripping members can be configured to prevent any longitudinal movement of the torque barrier relative to the borehole or casing wall, as well as preventing rotation of the torque barrier relative thereto. A blade would be an example of such a longitudinally stationary gripping member.

The novel features of this invention, as well as the invention itself, will be best understood from the attached drawings, taken along with the following description, in which similar reference characters refer to similar parts, and in which:

BRIEF DESCRIPTION OF THE SEVERAL VIEWS OF THE DRAWINGS

FIG. 8 is an elevation view of a gripping blade which can be mounted on the carrier shown in FIG. 2;

FIG. 9 is an elevation view of the gripping blade shown in FIG. 8, showing a fourth type of gripping contour;

FIG. 10 is an elevation view of a chain and sprocket gripping assembly which can be mounted on the carrier shown in FIG. 2; and FIG. 11 is a partial section view of a unidirectional gripping wheel mounted on the carrier shown in FIG. 2.

DETAILED DESCRIPTION OF THE INVENTION

Figure 1:
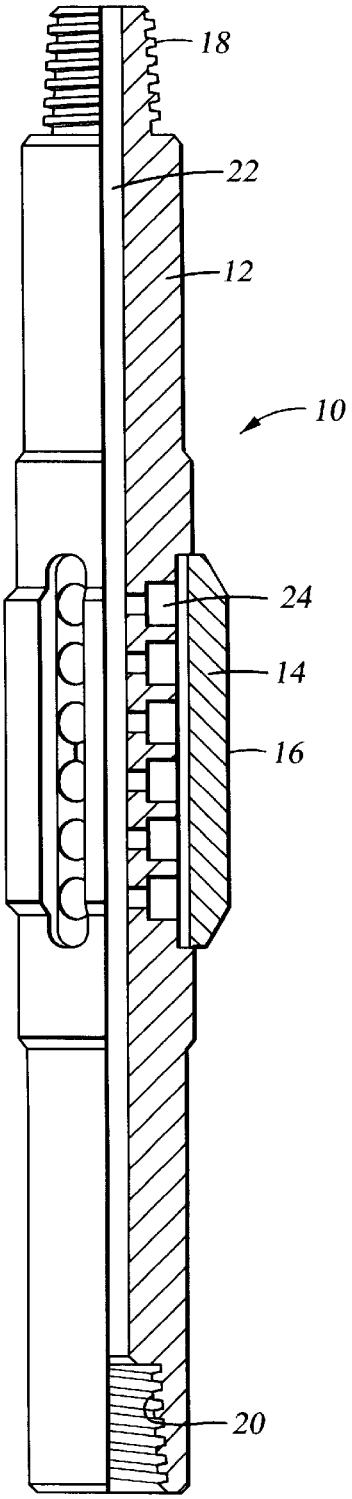
FIG. 1 is a partial longitudinal section view of a preferred embodiment of the anti-torque tool of the present invention.

As shown in FIG. 1, one embodiment of the anti-torque tool 10 of the present invention includes an elongated, substantially cylindrical, tool body 12 and one or more gripping members 14. Each gripping member 14 has an outwardly facing gripping surface 16 on which gripping contours are located, as will be described in more detail below. The tool body 12 has threads 18, 20 at its upper and lower ends for connection to an uphole work string (not shown) and a downhole rotating tool (not shown). A drilling fluid passageway 22 passes through the tool body 12, substantially along the longitudinal axis of the tool body 12. Further, a plurality of hydraulic channels 24 are connected in fluid communication to the drilling fluid passageway 22.

When the anti-torque tool 10 has been connected to a work string, and lowered into a borehole or casing, drilling fluid is pumped downhole through the work string to the anti-torque tool 10. The drilling fluid is pumped through the drilling fluid passageway 22 to a rotating tool connected below the anti-torque tool 10. Further, the drilling fluid is pumped at a sufficient flow rate and pressure to pass through the hydraulic channels 24 and exert hydraulic force to the inner face of the gripping members 14. This hydraulic force causes the gripping members 14 to move outwardly, transverse to the longitudinal axis of the tool body 12, until the gripping members 14 contact the wall of the borehole or casing into which the anti-torque tool 10 has been lowered. The gripping contours on the outer surfaces 16 of the gripping members 14 are forced into engagement with the borehole or casing wall. This prevents rotation of the anti-torque tool 10 relative to the borehole, thereby absorbing any reactive torque which may be generated by rotation of the mud motor or other downhole rotating tool.

Figure 2:
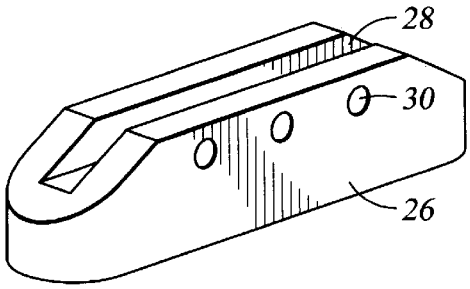
FIG. 2 is a perspective view of a carrier which can be incorporated in a gripping member on the tool shown in FIG. 1.

The gripping member 14 can have a number of different configurations, depending upon the type of wall to be engaged, and depending upon the degree to which longitudinal motion of the anti-torque tool 10 may be desired. FIG. 2 shows a carrier 26 which can be incorporated into the gripping member 14. The carrier 26 has a longitudinal groove 28 therein, for placement of a selected type of gripping element. A plurality of transverse holes 30 pass through both sides of the carrier 26, penetrating the groove 28, as pivot holes or positioning holes.

Figure 3:
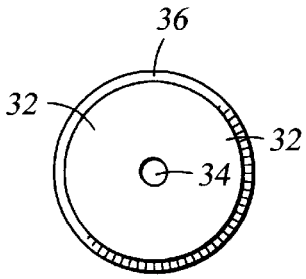
FIG. 3 is an elevation view of a first embodiment of a gripping wheel which can be mounted on the carrier shown in FIG. 2.
Figure 4:
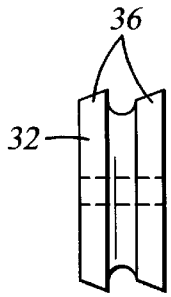
FIG. 4 is an elevation view of a first type of gripping contour, which can be incorporated in the gripping wheel shown in FIG. 3.
Figure 5:
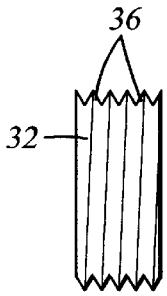
FIG. 5 is an elevation view of a second type of gripping contour, which can be incorporated in the gripping wheel shown in FIG. 3.
Figure 6:
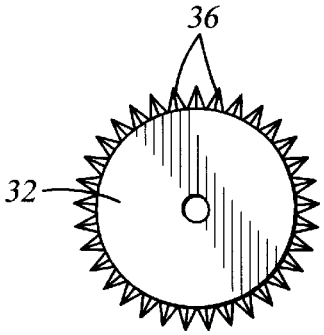
FIG. 6 is an elevation view of a second embodiment of a gripping wheel which can be mounted on the carrier shown in FIG. 2.
Figure 7:
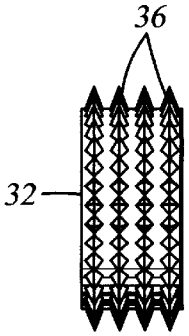
FIG. 7 is an elevation view of a third type of gripping contour, which can be incorporated in the gripping wheel shown in FIG. 6.

FIG. 3 shows a first embodiment of a gripping wheel 32, with a pivot hole 34 and a gripping contour 36 on its periphery. A plurality of gripping wheels 32, or some other type of rolling member, can be installed in the carrier 26, with each wheel 32 being pinned to one of the transverse holes 30 in the carrier 26, with a peripheral edge of each wheel 32 extending from the groove 28 of the carrier 26. Use of a gripping wheel 32 in the carrier 26 allows the anti-torque tool 10 to roll longitudinally along the wall of the borehole or casing, while still preventing rotation of the antitorque tool 10 relative to the wall. Various types of gripping contours 36 can be formed on the peripheral edge of the gripping wheel 32, thereby constituting the gripping surface 16 of the gripping member 14. Examples of some gripping contours are shown in FIGS. 4 and 5. In FIG. 4, the gripping contour 36 consists of a plurality of sharp-edged peripheral ribs with grooves therebetween, angled toward the direction of the anticipated reactive torque. In FIG. 5, the gripping contour 36 consists of one or more sharp-edged helical ridges. Further, FIGS. 6 and 7 show a gripping wheel 32 on which the gripping contour 36 consists of a plurality of sharpedged teeth. As the gripping member 14 is hydraulically extended from the anti-torque tool 10 as described above, the gripping contour 36 forcefully engages the wall of the casing or borehole and prevents rotation of the anti-torque tool 10.

If longitudinal motion of the anti-torque tool 10 is not desired, a gripping blade 38, as shown in FIG. 8, can be employed. Such a gripping blade 38, unlike the gripping wheel 32, resists longitudinal motion of the anti-torque tool 10, by forceful engagement of its gripping contours with the borehole wall or casing. The gripping blade 38 can be installed in the carrier 26, with the gripping blade 38 being held in place in the carrier 26 by having transverse holes 42 in the gripping blade pinned to the transverse holes 30 in the carrier 26. Alternatively, the entire gripping member 14 can be a gripping blade, without a carrier. In either case, a gripping contour 40 is formed on the outwardly facing surface of the gripping blade 38, thereby constituting the gripping surface 16 of the gripping member 14. As shown in FIG. 9, the gripping contour 40 on the edge of the gripping blade 38 can be a plurality of longitudinal teeth angled toward the direction of the anticipated reactive torque. Further, the gripping blade 38 could have a gripping contour similar to any of the contours shown in FIGS. 4, 5, and 7.

FIG. 10 shows another type of rolling member or mechanism which can be used as a gripping member. In this embodiment, a plurality of sprockets 44 and a chain 48 are installed in the groove 28 of the carrier 26. The sprockets 44 have center holes 46 which are rotationally pinned to the transverse holes 30 in the carrier 26. The chain 48 is wrapped continuously around the plurality of sprockets 44. The chain 48 can have sharp-edged links to forcefully engage the borehole or casing, preventing rotational motion of the anti-torque tool 10.

If it is desired to permit longitudinal motion of the anti-torque tool 10 in only one direction, the gripping wheels 32 or other rolling members can be configured to allow rotation of the rolling member in only one direction. An example of a mechanism for this purpose is shown in FIG. 11, where a ratchet mechanism consists of a pawl 50 which engages the teeth of the gripping contour 36 on the periphery of the gripping wheel 32. A spring 52 biases the pawl 50 against the periphery of the gripping wheel 32. The gripping wheel 32 can rotate clockwise as shown in the figure, since the teeth of the gripping contour 36 can slide past the end of the pawl 50, deflecting the pawl 50 outwardly as necessary. This allows the carrier 26, and the anti-torque tool 10, to move toward the left as shown in the figure, as the gripping wheel 32 rolls along the wall of the borehole or casing. However, if an external longitudinal force imposed on the anti-torque tool 10 were to urge the carrier 26 toward the right as shown in the figure, the gripping contour 36 on the gripping wheel 32 would grip the wall of the casing and urge the gripping wheel 32 to rotate counter-clockwise as shown in the figure. This rotation of the gripping wheel 32 would be prevented by engagement of the end of the pawl 50 with the teeth of the gripping contour 36.

A similar ratchet mechanism could be incorporated into any of the other rolling mechanisms shown herein, with the pawl 50 engaging an appropriate feature of the rolling mechanism, such as a splined shaft.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A device for preventing application of reactive torque to a work string by a downhole rotating tool, said device comprising:

a body non-rotatably mounted to a work string;

an elongate slotted carrier non-rotatably mounted on said body, said carrier being movable in an outward direction, substantially transverse to the longitudinal axis of said body, to engage a wall of a borehole;

a plurality of wheels mounted in a slot on said carrier by means of a plurality of transversely oriented pivot pins;

a hydraulic channel within said body, said hydraulic channel being adapted to apply hydraulic force to move said carrier in said outward transverse direction; and a gripping contour on an outwardly facing surface of each said wheel for engagement of a borehole wall, said gripping contour being configured to engage a borehole wall to resist rotation of said carrier about the longitudinal axis of said body.

2. A device as recited in claim 1, wherein said plurality of wheels are adapted to roll in at least one longitudinal direction along a borehole wall.

3. A device as recited in claim 2, wherein said plurality of wheels are adapted to roll in only one longitudinal direction along a borehole wall.

4. A device as recited in claim 3, further comprising a ratchet mechanism adapted to allow each said wheel to roll in only one longitudinal direction.

5. A device as recited in claim 1, further comprising a plurality of said slotted carriers non-rotatably mounted on said body for engagement of a wall of a borehole.

* * * * *